US006662876B2

(12) United States Patent
Lauritzen

(10) Patent No.: US 6,662,876 B2
(45) Date of Patent: Dec. 16, 2003

(54) METHOD AND APPARATUS FOR DOWNHOLE TUBULAR EXPANSION

(75) Inventor: Eric Lauritzen, Kingwood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 35 days.

(21) Appl. No.: 09/818,119

(22) Filed: Mar. 27, 2001

(65) Prior Publication Data

US 2002/0139540 A1 Oct. 3, 2002

(51) Int. Cl.[7] ..... E21B 19/16; E21B 43/08

(52) U.S. Cl. ..... 166/380; 166/227; 166/207

(58) Field of Search ..... 166/380, 207, 166/227, 378, 381, 387, 212

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 8/1959 | Hempel | 153/82 |
| 3,087,546 | A | 4/1963 | Wooley | 166/46 |
| 3,195,646 | A | 7/1965 | Brown | 166/208 |
| 3,203,483 | A | 8/1965 | Vincent | 166/207 |
| 3,467,180 | A | 9/1969 | Pensotti | 165/180 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |

(List continued on next page.)

FOREIGN PATENT DOCUMENTS

| | | | |
|---|---|---|---|
| EP | 0 961 007 A2 | 12/1999 | E21B/33/10 |
| GB | 2 320 734 A | 7/1998 | E21B/33/127 |
| GB | 2 336 383 A | 10/1999 | E21B/43/08 |
| WO | WO 93/24728 | 12/1993 | E21B/17/10 |
| WO | WO 98/42947 | 10/1998 | E21B/17/08 |
| WO | WO 99/18328 | 4/1999 | E21B/23/01 |
| WO | WO 99/23354 | 5/1999 | E21B/43/10 |
| WO | WO 00/50732 | 8/2000 | E21B/43/10 |

OTHER PUBLICATIONS

U.S. patent application Ser. No. 09/530,301, Metcalfe, filed Nov. 2, 1998.

U.S. patent application Ser. No. 09/470,154, Metcalfe, et al., filed Dec. 22, 1999.

U.S. patent application Ser. No. 09/469,692, Trahan, et al., filed Dec. 22, 1999.

(List continued on next page.)

*Primary Examiner*—David Bagnell
*Assistant Examiner*—Jennifer R. Dougherty
(74) *Attorney, Agent, or Firm*—Moser, Patterson & Sheridan, L.L.P.

(57) ABSTRACT

The present invention provides apparatus and methods for expanding tubulars in a wellbore. In one aspect, a process of sealing an annular area in a wellbore is provided in which a tubular having perforations at a predetermined location and a sleeve concentrically covering substantially all of the perforations is expanded into substantial contact with an inner diameter of a tubular, such as a casing or a liner. In another aspect, a process of sealing an annular area in a wellbore is provided in which a tubular having perforation at a predetermined location and a sleeve concentrically coving substantially all of the perforations is expanded into substantial contact with a junction between two tubulars, such as a liner and a casing, or between two liners.

21 Claims, 6 Drawing Sheets

U.S. PATENT DOCUMENTS

| | | | | | |
|---|---|---|---|---|---|
| 4,429,620 | A | | 2/1984 | Burkhardt et al. | 91/395 |
| 4,531,581 | A | | 7/1985 | Pringle et al. | 166/120 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 4,936,383 | A | * | 6/1990 | Towner et al. | 166/68 |
| 5,271,472 | A | | 12/1993 | Leturno | 175/107 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,560,426 | A | | 10/1996 | Trahan et al. | 166/120 |
| 5,685,369 | A | | 11/1997 | Ellis et al. | 166/195 |
| 5,794,702 | A | * | 8/1998 | Nobileau | 166/380 |
| 5,833,001 | A | * | 11/1998 | Song et al. | 166/187 |
| 5,901,787 | A | | 5/1999 | Boyle | 166/135 |
| 5,901,789 | A | | 5/1999 | Donnelly et al. | 166/381 |
| 5,954,136 | A | * | 9/1999 | McHugh et al. | 166/384 |
| 6,021,850 | A | | 2/2000 | Wood et al. | 166/380 |
| 6,098,717 | A | | 8/2000 | Bailey et al. | 166/382 |
| 6,189,616 | B1 | | 2/2001 | Gano et al. | 166/298 |

OTHER PUBLICATIONS

U.S. patent application Ser. No. 09/469,690, Abercrombie, filed Dec. 22, 1999.

U.S. patent application Ser. No. 09/469,681, Metcalfe, et al., filed Dec. 22, 1999.

U.S. patent application Ser. No. 09/469,643, Metcalfe, et al., filed Dec. 22, 1999.

U.S. patent application Ser. No. 09/469,526, Metcalfe, et al., filed Dec. 22, 1999.

U.S. patent application Ser. No. 09/462,654, Metcalfe, filed Jul. 13, 1998.

PCT International Search Report, PCT/GB 02/01395, dated Sep. 17, 2002.

* cited by examiner

METHOD AND APPARATUS FOR DOWNHOLE TUBULAR EXPANSION

BACKGROUND OF THE INVENTION

1. Field of the Invention

This invention relates to downhole sealing, and to an apparatus and method for use in forming an arrangement to allow creation of a downhole seal. Generally, the invention relates to the provision of a seal or packer between concentric downhole tubing, such as a bore-lining casing and production casing.

2. Background of the Related Art

In the oil and gas exploration and production industry, bores are drilled to access hydrocarbon-bearing rock formations. The drilled bores are lined with steel tubing, known as casing or liner, which is cemented in the bore. Oil and gas are carried from the hydrocarbon-bearing or production formation to the surface through smaller diameter production tubing which is run into the fully cased bore. Typical production tubing incorporates a number of valves and other devices which are employed, for example, to allow the pressure integrity of the tubing to be tested as it is made up, and to control the flow of fluid through the tubing. Further, to prevent fluid from passing up the annulus between the inner wall of the casing and the outer wall of the production tubing, at least one seal, known as a packer, may be provided between the tubing and the casing. The tubing will normally be axially movable relative to the packer, to accommodate expansion of the tubing due to heating and the like. The packer may be run in separately of the tubing, or in some cases may be run in with the tubing. In any event, the packer is run into the bore in a retracted or non-energized position, and at an appropriate point is energized or "set" to fix the packer in position and to form a seal with the casing. A typical packer will include slips which grip the casing wall and an elastomeric sealing element which is radially deformable to provide a sealing contact with the casing wall and which energizes the slips. Accordingly, a conventional packer has a significant thickness, thus reducing the available bore area to accommodate the production tubing. Thus, to accommodate production tubing of a predetermined diameter, it is necessary to provide relatively large diameter casing, and thus a relatively large bore, with the associated increase in costs and drilling time. Further, the presence of an elastomeric element in conventional packers limits their usefulness in high temperature applications.

Therefore, there is a need to provide a means of sealing production tubing relative to casing which obviates the requirement to provide a conventional packer, by providing a relatively compact or "slimline" sealing arrangement.

Additionally, recent industry trends have demanded the need for expandable tubular systems, where tubulars are expanded in situ. There is a need, therefore, for a packer that utilizes this in situ expansion technology. Also, some applications for packers now require high tensile strength and/or pressure ratings across the seal. These pressure ratings are conceivably as much as 10,000 psi or higher. There is a further need, therefore, for a packer using expandable tubulars that results in an exceptionally high sealing strength.

BRIEF SUMMARY OF THE INVENTION

In one aspect, a method and apparatus for sealing an annular area in a wellbore is provided in which a tubular is placed in the wellbore, the tubular having perforations, or slots, at a predetermined location and a sleeve concentrically covering substantially all of the perforations. Placing an expansion tool in the tubular. Energizing the expansion tool and causing extendable members therein to extend radially to contact an inner wall of the tubular. The tubular is thereby expanded into substantial contact with an inner diameter of a casing or a liner, wherein substantially no gap exists between the sleeve and the casing or the liner.

In another aspect, a process of sealing an annular area in a wellbore is provided in which a tubular is placed in the wellbore at a junction between a casing and a finer or a junction between a liner and another liner. The tubular has perforations, or slots, at a predetermined location and a sleeve concentrically covering substantially all of the perforations. Placing an expansion tool in the tubular. Energizing the expansion tool causing extendable members therein to extend radially to contact an inner wall of the tubular. The tubular is thereby expanded into substantial contact with an inner diameter of the liner and/or casing.

In yet another aspect, a process of sealing an annular area in a wellbore is provided in which a tubular and an expansion tool assembly is placed in the wellbore. The tubular having perforations, or slots, at a predetermined location and a sleeve concentrically covering substantially all of the perforations. Energizing the expansion tool causing extendable members therein to extend radially to contact an inner wall of the tubular. Thereby expanding the tubular into substantial contact with an inner diameter of the liner and/or casing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
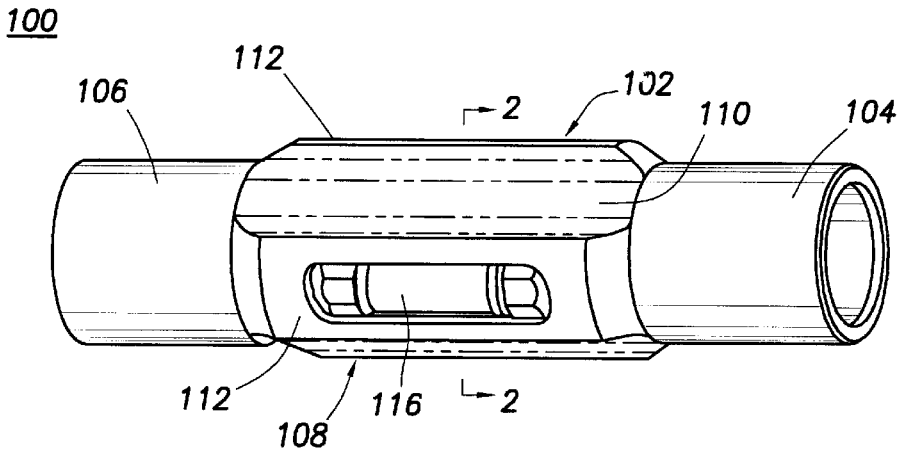
FIG. 1 is a perspective view of an expansion tool of the present invention.
Figure 2:
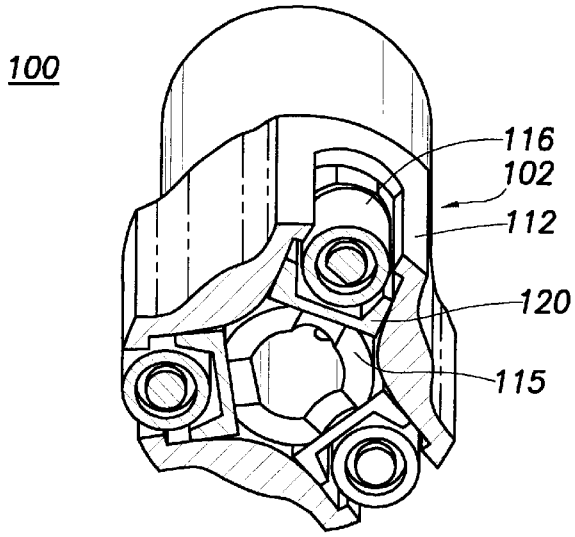
FIG. 2 is a perspective end view in section thereof.
Figure 3:
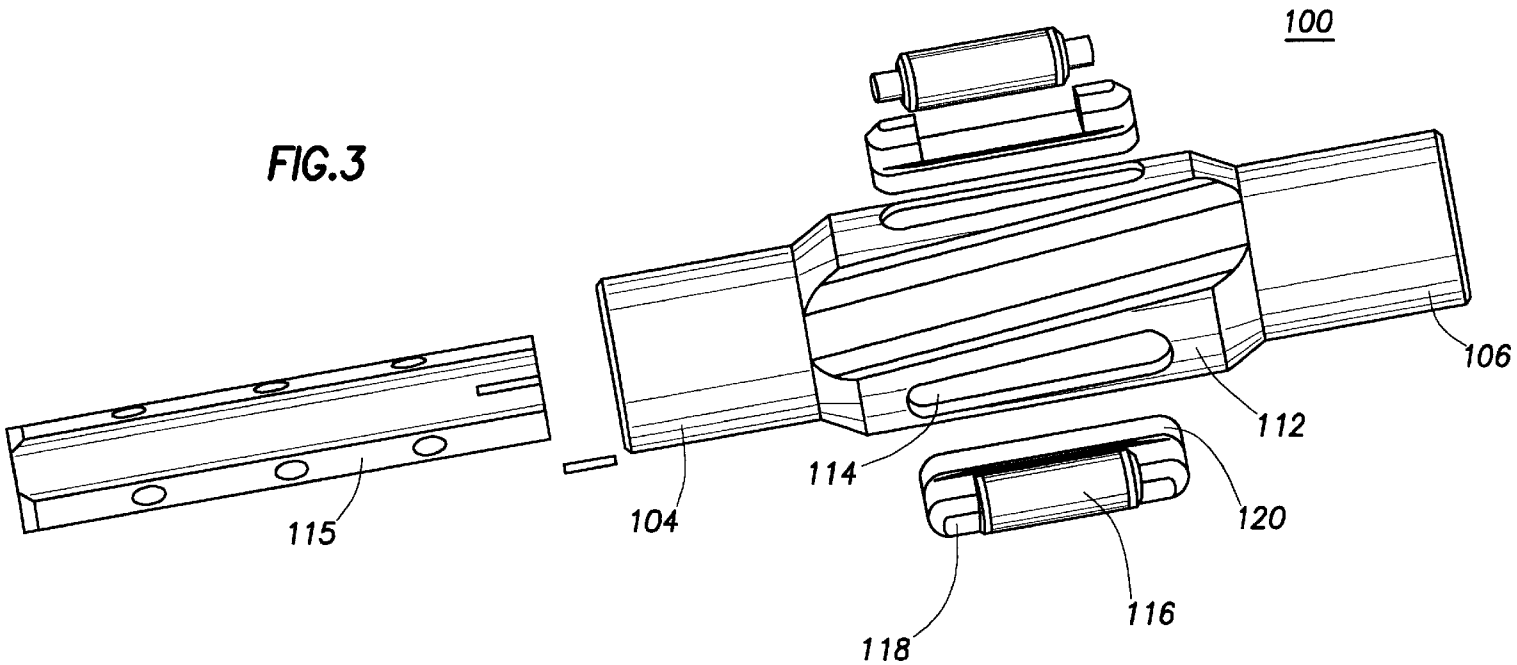
FIG. 3 is an exploded view of the expansion tool.

The present invention provides apparatus and methods for expanding tubulars in a wellbore. FIGS. 1 and 2 are perspective views of an expansion tool 100 and FIG. 3 is an exploded view thereof. The expansion tool 100 has a body 102 which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 100 to the exterior of the respective land 112. Each of the mutually identical rollers 116 is near-cylindrical and slightly barreled. Each of the rollers 116 is mounted by means of a bearing 118 at each end of the respective roller for rotation about a respective rotational axis which is parallel to the longitudinal axis of the tool 100 and radially offset therefrom at 120-degree mutual circumferential separations around the central body 108. The bearings 118 are formed as integral end members of radially slidable pistons 120, one piston 120 being slidably sealed within each radially extended recess 114. The inner end of each piston 120 (FIG. 1) is exposed to the pressure of fluid within the hollow core of the tool 100 by way of the radial perforations in the tubular core 115. In this manner, pressurized fluid provided from the surface of the well, via a tubular, can actuate the pistons 120 and cause them to extend outward and to contact the inner wall of a tubular to be expanded.

Figure 4A:
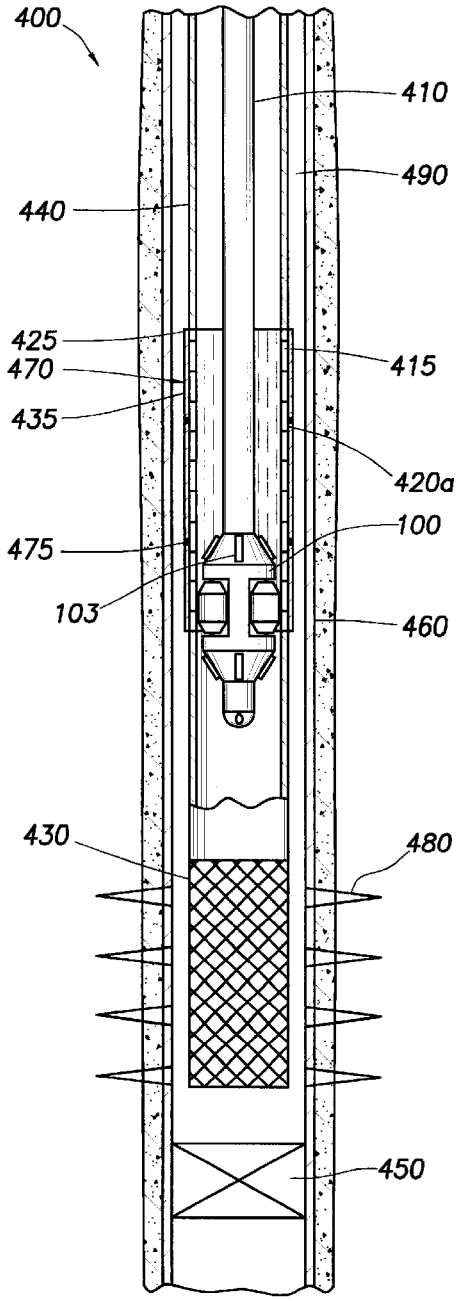
FIG. 4*a* is a section view of an embodiment of the invention including an expansion tool disposed on an end of a run-in tubular, a first tubular, a second perforated tubular, o-ring seals, and a bridge plug.

FIG. 4*a* is a section view of an embodiment of the invention including an expansion tool 100 disposed on an end of a run-in tubular 410, a perforated or slotted tubular 420*a*, o-ring seals 470, 475, and a bridge plug 450. In this aspect, the perforated section of tubular will replace the need for a conventional production packer. Preferably, a tubular 420*a* having a thickness that is commensurate with a desired load strength is provided, but has slots or perforations 415 in the tubular 420*a*. The slots or perforations 415 reduce the tangential strength of the tubular 420*a*, thereby, requiring less work to expand the tubular 420*a* than a solid tubular.

Generally, the wellbore 400 has a first tubular, or casing, 460 and production perforations 480 disposed therein. A second tubular of smaller diameter, or production tubular 440 having a perforated, or slotted, section of tubular 420*a*, and a screen 430 disposed on the end thereof, are run into the casing 460. The perforated tubular 420*a* is connected to the production tubular 440 by any conventional means. Tubular 420*a* has perforations 415 which may be slots of oval shape, diamond shape, or any other geometry that reduces tensile hoop stresses, and a sleeve 425 concentrically covering substantially all of the perforations 415. The sleeve 425 is made of a ductile material, such as copper, stainless steel, tempered chrome, or a thermoplastic, and has an elastomer outer coating, or skin 435. The sleeve may be shouldered into position or welded into position. A first sealing member 470, such as an o-ring, concentrically covers a top portion of the outer diameter of the sleeve 425, and a second sealing member 475 concentrically covers a bottom portion of the outer diameter of the sleeve 425.

The expansion tool 100 is run into the tubular 440, 420*a* by a run-in tubular 410, or coil tubing, which may also be used to provide electrical power and hydraulic fluid to the expansion tool 100. Referring again to FIG. 1, fluid pressure to actuate the rollers 116 of the expansion tool 100 is provided from the surface of the well through a run-in tubular 410, or coiled tubing string. The expander tool 100 includes at least one aperture 101 at a lower end thereof. Aperture 101 permits fluid to pass through the apparatus and to circulate back to the surface of the well.

The tubular disposed around the apparatus of the present invention could be a piece of production tubing, or liner or slotted liner which requires either the expansion of a certain length thereof or at least a profile formed in its surface to affix the tubular within an outer tubular or to facilitate use with some other downhole tool. In FIG. 4*a*, the annulus 490 between the tubular 440, 420*a* and the wellbore 400 could be a void or could be filled with non-cured cement.

In use, the expansion tool 100 is lowered into the wellbore 400 to a predetermined position and thereafter pressurized fluid is provided in the run-in tubular 410. In the preferred embodiment, some portion of the fluid is passed through an orifice or some other pressure increasing device and into the expansion tool 100 where the fluid urges the rollers 116 outwards to contact the wall of the tubular 420*a* therearound. The expansion tool 100 exerts forces against the wall of a tubular 420*a* therearound while rotating and, optionally, moving axially within the wellbore 400. The result is a tubular that is expanded past its elastic limits along at least a portion of its outside diameter. Gravity and the weight of the components urges the expansion tool 100 downward in the wellbore 400 even as the rollers 116 of the expander tool 100 are actuated. The expansion can also take place in a "bottom up" fashion by providing an upward force on the run-in tubular string. A tractor (not shown) may be used in a lateral wellbore or in some other circumstance when gravity and the weight of the components are not adequate to cause the actuated expansion tool 100 to move downward along the wellbore 400. Additionally, the tractor may be necessary if the tool 100 is to be used to expand the tubular 420*a* wherein the tractor provides upward movement of the expansion tool 100 in the wellbore 400.

At an upper and a lower end of the expansion tool 100 shown in FIGS. 4*a–b*, 5*a–b* and 6 are a plurality of non-compliant rollers constructed and arranged to initially contact and expand a tubular prior to contact between the tubular and fluid actuated rollers 116. Unlike the compliant, fluid actuated rollers 116, the non-compliant rollers 103 are supported only with bearings and they do not change their radial position with respect to the body portion of the tool 100.

Figure 4B:
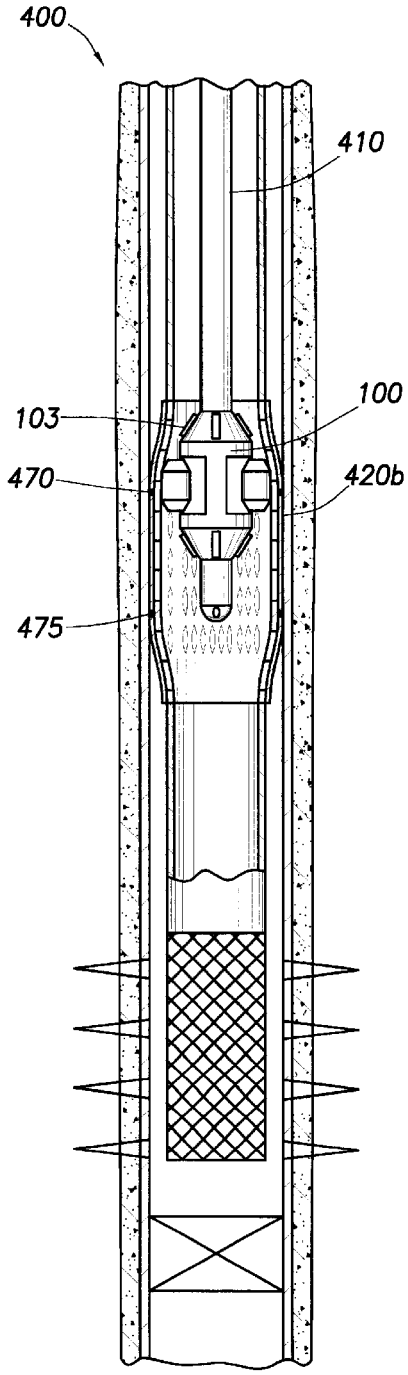
FIG. 4*b* is a section view of the embodiment shown in FIG. 4*a*, wherein the second tubular has been partially expanded.

FIG. 4*b* is a section view of the embodiment shown in FIG. 4*a*, wherein the tubular 420*b* has been partially expanded by the expansion tool 100 into an inner diameter of the casing 460.

Figure 4C:
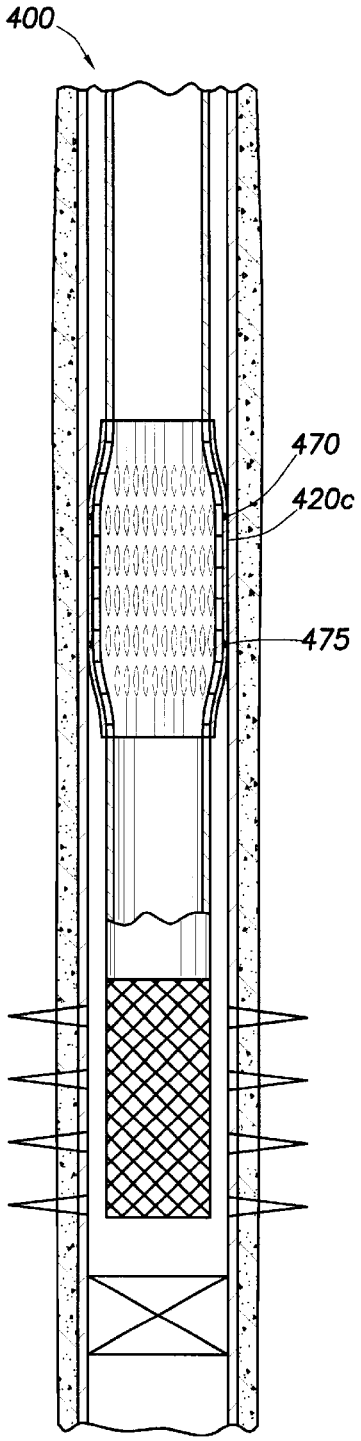
FIG. 4*c* is a section view of the embodiment shown in FIGS. 4*a–b*, wherein the second tubular has been expanded and the extension tool removed.

FIG. 4*c* is a section view of the embodiment shown in FIGS. 4*a–b*, wherein the tubular 420*c* has been expanded into the casing 460 and the extension tool 100 removed. The junction between the tubular 420*c* and the inner diameter of the casing 460 has been substantially sealed and is structurally supported in this manner. Sealing members 470, and 475 further reinforce the seal at the top and bottom portions of the outer diameter of the sleeve 425 creating a "zero interference fit" between the tubular 420*c* and the casing 460. The sleeve 425 is essentially sandwiched between the inner diameter of the casing 460 and the outer diameter of the perforated tubular 420*c*. Preferably, no gap exists between the sleeve 425 and the casing 460. With the casing 460 now supporting the sleeve 425, the collapse strength of the sleeve 425 and tubular 420*a* is enhanced because the material must shear to fail rather than buckle. The constrained tubular 420*c* has a collapse strength of about two and a half times of the unexpanded tubular 420*a*. Additionally, the constrained tubular 420*c* and sealing members 470, and 475 can withstand pressure exerted in the annulus 490 above and below the junction, as well as the constrained tubular 420*c*, or combinations thereof, of up to about 10,000 psi. It is also contemplated that this aspect of the invention would have valuable application at higher pressures of up to about 15,000 psi, such as in deep water operations.

Figure 5A:
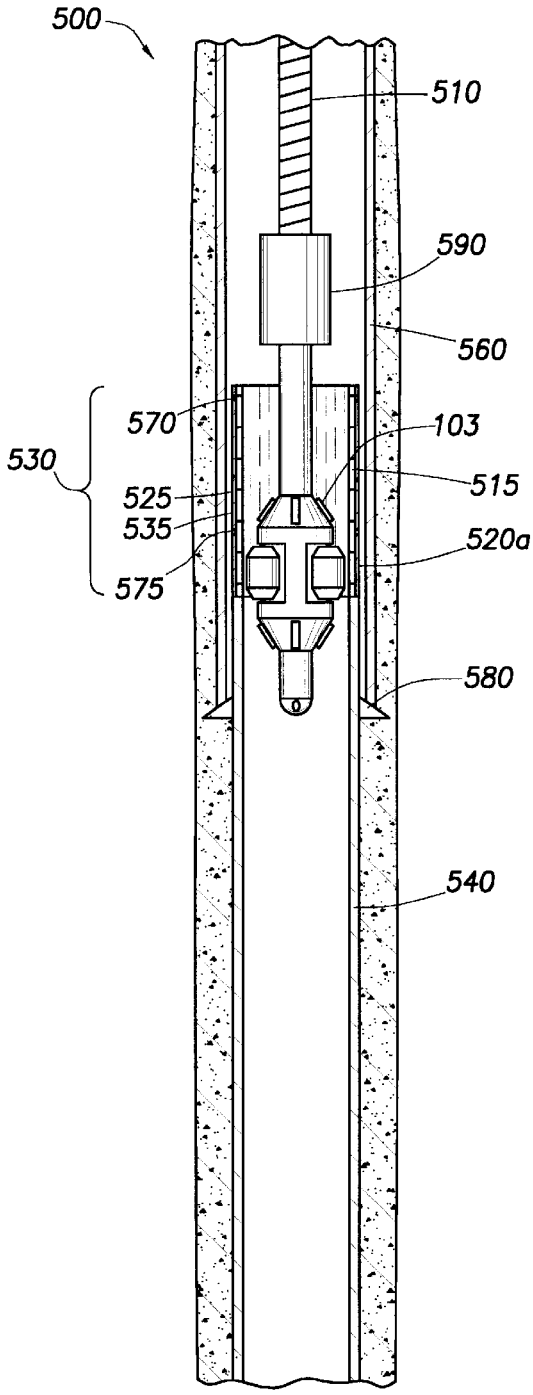
FIG. 5*a* is a section view of an embodiment of the invention, including an expansion tool disposed on an end of coil tubing, a junction between a first tubular and a second tubular having perforated section.

FIG. 5*a* is a section view of an embodiment of the invention, including an expansion tool 100 disposed on an end of coil tubing 510, or a run-in tubular, a junction 530 between a first tubular 560, such as a casing or a liner, and a second tubular 540 having a perforated or slotted tubular section 520*a*. In this aspect, the perforated section of tubular will replace the need for a conventional liner top packer.

Generally, the wellbore 500 has a first tubular 560, such as a casing or a liner. A second tubular of smaller diameter, or liner 540, having a perforated, or slotted, section of tubular 520*a* disposed at the top end thereof is run into the first tubular 560. The perforated tubular 520*a* is connected to the second tubular 520 by any conventional means and is made of the same material described in reference to FIGS. 4*a–c*. The perforated tubular 520*a* has perforations or slots 515, a sleeve 525 substantially covering the perforations, and an outer skin 535. The liner 540 is set with a conventional hanger assembly 580.

Figure 6:
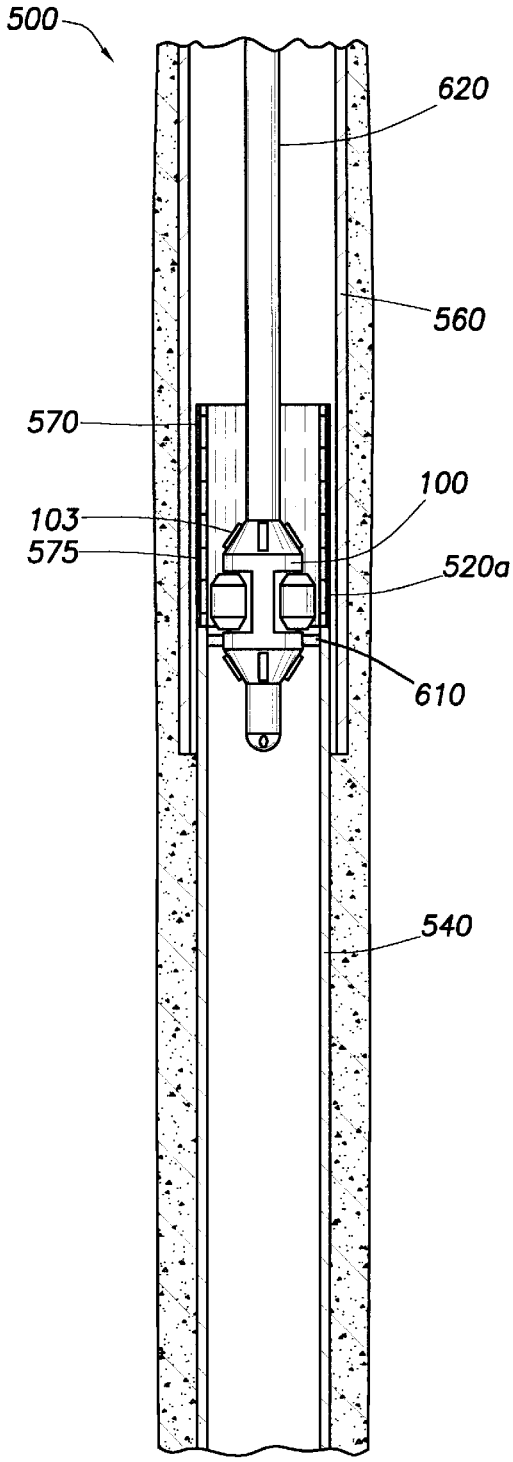
FIG. 6 is a section view of an embodiment of the invention, wherein the expansion tool disposed on an end of a run-in tubular, and a section of perforated tubular is inserted into a wellbore as an assembly to create a seal between a junction of two tubulars.

A mud motor 590 provides rotational forces to the expansion tool 100. The structure of the mud motors is well known. The mud motor can be a positive displacement Moineau-type device and includes a lobed rotor that turns within a lobed stator in response to the flow of fluids under pressure in the coiled tubing 510. The mud motor 590 provides rotational force to rotate the expansion tool 100 in the wellbore 500 while the rollers 116 are actuated against an inside surface of the tubular 520*a*. Pressurized fluid passes through the mud motor 590 providing rotational movement to an output shaft (not shown) that is connected to the expansion tool 100 to provide rotation thereto. Alternatively, the liner 540 may be set by running the liner 540 and the expansion tool 100, disposed on an end of a run-in tubular, into the wellbore 500 as an assembly (as shown in FIG. 6 and further discussed below). It should be understood that a coil tubing and mud motor may be used with the embodiments of the invention described in FIGS. 4*a–c*, as well.

Figure 5B:
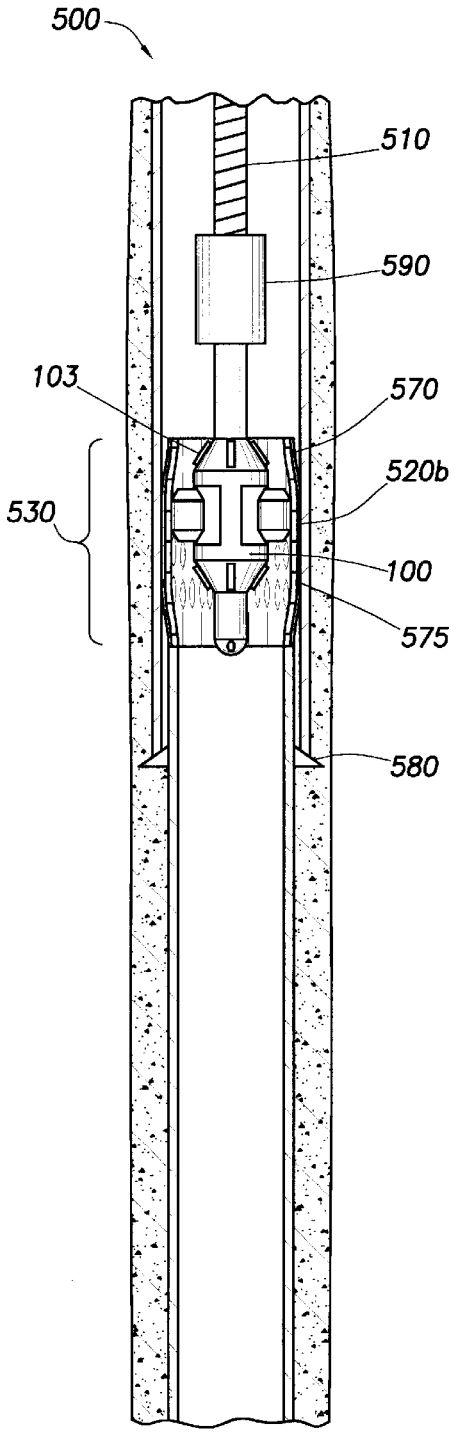
FIG. 5*b* is a section view of the embodiment shown in FIG. 5*a*, wherein the second tubular has been partially expanded.

FIG. 5*b* is a section view of the embodiment shown in FIG. 5*a*, wherein the perforated section of tubular 520*b* has been partially expanded into the first tubular 560. The perforated tubular 520*b*, disposed above the solid section of tubular 540, is expanded until the perforated tubular 520*b*, sleeve 525, and sealing members 570, and 575 are in substantial contact with the inner diameter of the first tubular 560.

Figure 5C:
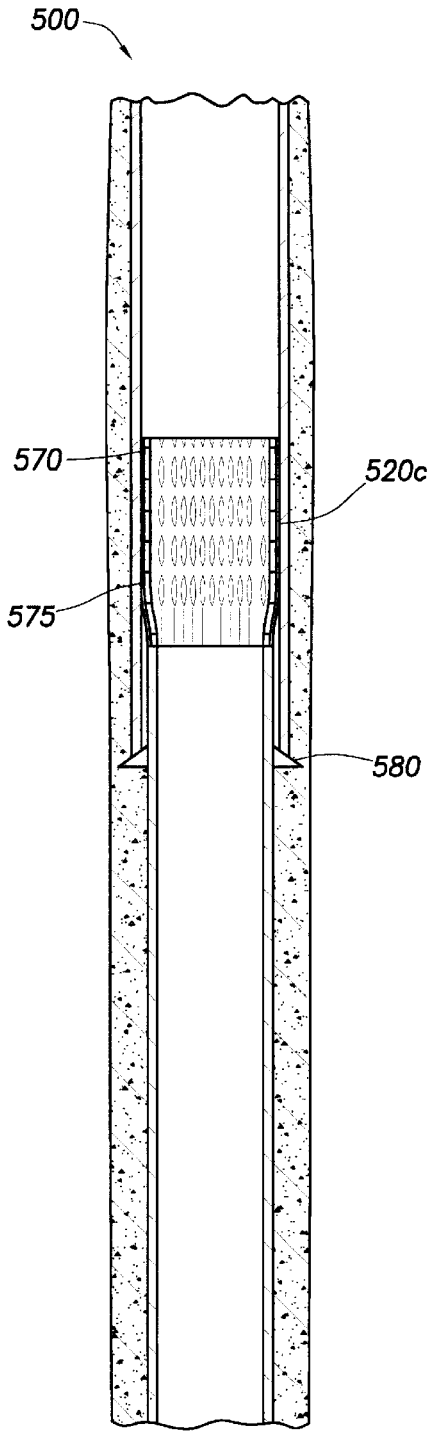
FIG. 5*c* is a section view of the embodiment shown in FIGS. 5*a–b*, wherein the second tubular has been expanded and the extension tool removed.

FIG. 5*c* is a section view of the embodiment shown in FIGS. 5*a–b*, wherein the perforated section 520*c* of the second tubular 540 has been expanded into the first tubular 560 and the expansion tool 100 removed. Thereby sealing the junction 530 between the first and second tubulars 560, 540. Preferably, there is no gap between the sleeve 525 and the first tubular 560.

FIG. 6 is a section view of an embodiment of the invention, wherein the expansion tool 100 and a second tubular 540 having a section of perforated tubular 520*a* are placed into a wellbore as an assembly to create a seal between a junction 530 of two tubulars. The expansion 100 is disposed within the second tubular and held therein with a temporary, shearable connection 610. In one embodiment, the tool 100 and the tubular 540 are run into the wellbore 500 on a run-in tubular 620 which provides hydraulic fluid to the tool. The tubular 540 is then set by any conventional means or as described below with reference to FIG. 7. The connection 610 is sheared by an upward force on the run-in tubular, the tool energized, and the perforated tubular 520*a* expanded.

Figure 7:
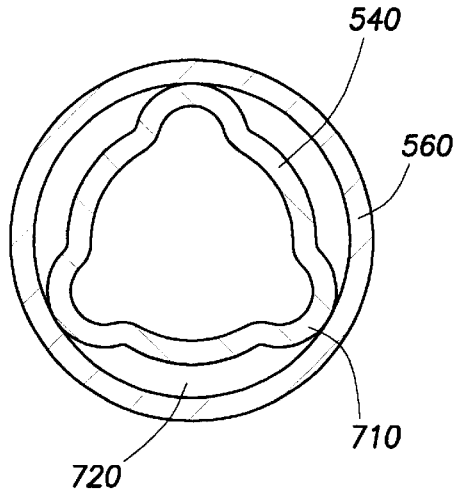
FIG. 7 is a top view of an embodiment of the invention, wherein a second, smaller tubular is partially expanded into a first tubular to hang the second tubular.

FIG. 7 is a top section view of an embodiment of the invention, wherein a second, smaller tubular 540, or liner, is partially expanded into a first tubular 560 to temporarily hang the second tubular. This embodiment is especially useful to set a liner in a wellbore without the use of a conventional liner hanger. To set the liner 540, the expansion tool 100 is energized and radially expands one or more sections 710 of the second tubular 540, disposed below the perforated section of tubular 520*a*, into the first tubular 560, thereby fixing the liner 540 in the wellbore. The unexpanded sections 720 of tubular 540 allow for the passage of fluid, such as cement. Depending upon the requirements of the operator, a fluid path may be left between the expanded tubular and the wellbore in order to provide a flow path for fluids, including cement. For example, the tubular may be expanded in a spiral fashion leaving flute-shaped spaces for the passage of cement or other fluids. The perforated section of tubular 520*a* is then expanded to create a seal between the two tubulars. Optionally, the second tubular 540 may be expanded to smooth out the one or more sections 710 after cementing and the tubulars 540 and 520*a* may then be expanded in a "bottom-up" fashion. It should be understood that the method described herein is especially useful in the embodiments of FIGS. 5*a–c* and 6.

While the foregoing is directed to the preferred embodiment of the present invention, other and further embodiments of the invention may be devised without departing from the basic scope thereof, and the scope thereof is determined by the claims that follow.

What is claimed is:

1. An apparatus for sealing an annular area in a wellbore, comprising:

a tubular having perforations at predetermined locations in a wall thereof;

a sleeve concentrically covering substantially all of the perforations;

a first sealing member concentrically covering a top portion of an outer diameter of the sleeve; and a second sealing member concentrically covering a bottom portion of the outer diameter of the sleeve.

2. The apparatus of claim 1, wherein the first and second sealing members are o-rings.

3. The apparatus of claim 1, wherein the perforations are diamond slots or oval slots.

4. The apparatus of claim 1, wherein the sleeve comprises:

a ductile material; and an elastomer outer coating.

5. An apparatus for sealing an annular area in a wellbore, comprising:

a tubular having perforations at predetermined locations in a wall thereof;

a means for covering substantially all of the perforations; and a first and a second means for sealing a top portion and a bottom portion between an outer diameter of the tubular and an inner diameter of the wellbore.

6. The apparatus of claim 5, wherein the means for covering is a sleeve concentrically covering substantially all of the perforations.

7. The apparatus of claim 5, wherein the first and second means for sealing are o-ring seals.

8. A method of sealing an annular area in a wellbore, comprising:

placing a tubular in the wellbore, the tubular having perforations at a predetermined location and a sleeve concentrically covering substantially all of the perforations;

placing an expansion tool in the tubular, the expansion tool disposed on a run-in string of tubulars;

energizing the expansion tool and causing extendable members therein to extend radially to contact an inner wall of the tubular; and expanding the tubular into substantial contact with an inner diameter of the wellbore, wherein substantially no gap exists between the sleeve and the wellbore.

9. The method of claim 8, further comprising:

placing a bridge plug disposed below the tubular.

10. The method of claim 8, wherein the run-in string of tubulars is a coiled tubing.

11. The method of claim 8, wherein the wellbore is lined with a casing.

12. The method of claim 8, wherein the wellbore is lined with a liner.

13. A method of sealing an annular area in a wellbore, comprising:

placing a first tubular in the wellbore;

placing a second tubular in the wellbore, the second tubular having perforations at a predetermined location and a sleeve concentrically covering substantially all of the perforations;

placing an expansion tool in the second tubular;

energizing the expansion tool and causing extendable members therein to extend radially to contact an inner wall of the second tubular; and expanding the second tubular into substantial contact with an inner diameter of the first tubular at a junction between the first tubular and the second tubular.

14. The method of claim 13, further comprising:

hanging the second tubular by radially expanding one or more non-perforated sections of the second tubular into contact with a wall of the first tubular.

15. The method of claim 13, wherein the second tubular and the expansion tool are placed in the wellbore as an assembly.

16. The method of claim 13, herein the first tubular is a casing.

17. The method of claim 13, the first tubular is a liner.

18. An apparatus for sealing an annular area formed between the apparatus and a wellbore therearound, the apparatus comprising:

a slotted tubular having means for connection to another tubular at a first end; and a sleeve member disposed around, attached to the slotted tubular, and covering substantially all of the slots, whereby the apparatus is expandable by a radial outward force applied to an inner wall of the slotted tubular.

19. A method of sealing an annular area in a wellbore, comprising:

placing a tubular in the wellbore;

the tubular having perforations at a predetermined location and a sleeve concentrically covering substantially all of the perforations;

placing a means for expanding the tubular within the wellbore; and expanding the tubular into substantial contact with an inner diameter of the wellbore.

20. An apparatus for sealing an annular area in a wellbore, comprising:

a tubular having perforations at predetermined locations in a wall thereof;

a sleeve concentrically covering substantially all of the perforations;

wherein the a sleeve comprises an elastomer outer coating and a ductile material that is copper, stainless steel, tempered chrome, or a thermoplastic;

a first sealing member concentrically covering a top portion of an outer diameter of the sleeve; and a second sealing member concentrically covering a bottom portion of the outer diameter of the sleeve.

21. A method of sealing an annular area in a wellbore, comprising:

placing a first tubular in the wellbore;

placing a second tubular in the wellbore, the second tubular having perforations at predetermined location and a sleeve concentrically covering substantially all of the perforations;

placing an expansion tool in the second tubular;

energizing the expansion tool and causing extendable members therein to end radially to contact an inner wall of the second tubular;

circulating cement between the tubulars; and expanding the second tubular into substantial contact with an inner diameter of the first tubular at a junction between the first tubular and the second tubular.

* * * * *

UNITED STATES PATENT AND TRADEMARK OFFICE

CERTIFICATE OF CORRECTION

PATENT NO. : 6,662,876 B2
DATED : December 16, 2003
INVENTOR(S) : Lauritzen

It is certified that error appears in the above-identified patent and that said Letters Patent is hereby corrected as shown below:

Column 8,
Line 4, please change “herein” to -- wherein --.
Line 36, please change “the a sleeve” to -- the sleeve --.
Line 52, please change “end” to -- extend --.

Signed and Sealed this

Twenty-ninth Day of June, 2004

JON W. DUDAS
*Acting Director of the United States Patent and Trademark Office*